US005173638A

United States Patent [19]

Eliasson et al.

[11] Patent Number: 5,173,638

[45] Date of Patent: Dec. 22, 1992

[54] HIGH-POWER RADIATOR

[75] Inventors: Baldur Eliasson, Birmenstorf; Peter Erni, Baden; Michael Hirth, Unterentfelden; Ulrich Kogelschatz, Hausen, all of Switzerland

[73] Assignee: BBC Brown, Boveri Ag, Baden, Switzerland

[21] Appl. No.: 723,674

[22] Filed: Jun. 27, 1991

Related U.S. Application Data

[63] Continuation of Ser. No. 405,571, Sep. 7, 1989, abandoned, which is a continuation of Ser. No. 294,740, Jan. 9, 1989, abandoned, which is a continuation of Ser. No. 76,926, Jul. 22, 1987, Pat. No. 4,837,484.

[30] Foreign Application Priority Data

Jul. 22, 1986 [CH] Switzerland ..... 2924/86

[51] Int. Cl.[5] ..... H01J 17/16

[52] U.S. Cl. ..... 313/634; 313/607; 313/573; 313/234; 313/35; 313/45

[58] Field of Search ..... 313/38, 37, 40, 45, 313/565, 573-575, 607, 621, 622, 634, 231.71, 234

[56] References Cited

U.S. PATENT DOCUMENTS

| | | | |
|---|---|---|---|
| 2,763,806 | 9/1956 | Anderson, Jr. | 313/634 X |
| 3,816,784 | 6/1974 | Weninger | 313/39 X |
| 4,266,166 | 5/1981 | Proud et al. | 315/248 |
| 4,325,006 | 4/9182 | Morton | 313/634 X |

FOREIGN PATENT DOCUMENTS

| | | |
|---|---|---|
| 739064 | 3/1970 | Belgium . |
| 2023980 | 3/1980 | United Kingdom . |

OTHER PUBLICATIONS

Japanese patent abstract, No. 60-79663 (A), vol. 9 No. 219(M-410) (1942) Sep. 6, 1985.

"Vacuum-Ultraviolet Lamps with a Barrier Discharge in Inert Gases" Volkova et al., New Instruments and Materials, 1985 Plenum Publishing Corp., pp. 1194-1197.

*Primary Examiner*—Donald J. Yusko
*Assistant Examiner*—Michael Horabik
*Attorney, Agent, or Firm*—Oblon, Spivak, McClelland, Maier & Neustadt

[57] ABSTRACT

The high-power radiator includes a discharge space (12) bounded by a metal electrode (8), cooled on one side, and a dielectric (9) and filled with a noble gas or gas mixture, both the dielectric (9) and also the other electrode situated on the surface of the dielectric facing away from the discharge space (12) being transparent for the radiation generated by quiet electric discharges. In this manner, a large-area UV radiator with high efficiency is created which can be operated at high electrical power densities of up to 50 kW/m$^2$ of active electrode surface.

9 Claims, 2 Drawing Sheets

HIGH-POWER RADIATOR

This application is a continuation of application Ser. No. 07/405,574, filed on Sep. 7, 1989, now abandoned, which is a continuation of application Ser. No. 07/294,740, filed May 7, 1987, now abandoned, which is a continuation of application Ser. No. 07,076,926, filed Jul. 22, 1987, now U.S. Pat. No. 4,837,484.

DESCRIPTION

1. Technical Field

The invention relates to a high-power radiator, in particular for ultraviolet light, having a discharge space filled with filling gas whose walls are formed, on the one hand, by a dielectric, which is provided with first electrodes on its surface facing away from the discharge space, and are formed, on the other hand, from second electrodes or likewise by a dielectric, which is provided with second electrodes on its surface facing away from the discharge space, having an alternating current source for supplying the discharge connected to the first and second electrodes, and also means for conducting the radiation generated by quiet electrical discharge into an external space.

At the same time, the invention is related to a prior art as it emerges, for example from the publication "Vacuum-ultraviolet lamps with a barrier discharge in inert gases" by G. A. Volkova, N. N. Kirillova, E. N. Pavlovskaya and A. V. Yakovleva in the Soviet journal Zhurnal Prikladnoi Spektroskopii 41 (1984), No. 4,691-695, published in an English-Language translation by the Plenum Publishing Corporation 1985, $ 08.50, p. 1194 ff.

2. Prior Art

For high-power radiators, in particular high-power UV radiators, there are various applications such as, for example, sterilization, curing of lacquers and synthetic resins, flue-gas purification, destruction and synthesis of special chemical compounds. In general, the wavelength of the radiator has to be tuned very precisely to the intended process. The most well-known UV radiator is presumably the mercury radiator which radiates UV radiation with a wavelength of 254 nm and 185 nm with high efficiency. In these radiators a low-pressure glow discharge burns in a noble gas/mercury vapour mixture.

The publication mentioned in the introduction entitled "Vacuum ultraviolet lamps . . ." describes a UV radiation source based on the principle of the quiet electric discharge. This radiator consists of a tube of dielectric material with rectangular cross-section. Two opposite walls of the tube are provided with planar electrodes in the form of metal foils which are connected to a pulse generator. The tube is closed at both ends and filled with a noble gas (argon, krypton or xenon). When an electric discharge is ignited, such filling gases form so-called excimers under certain conditions. An excimer is a molecule which is formed from an excited atom and an atom in the ground state.

for example, $Ar + Ar^* \rightarrow AR^*_2$

It is known that the conversion of electron energy into UV radiation takes place very efficiently with excimers. Up to 50% of the electron energy can be converted into UV radiation, the excited complexes having a life of only a few nanoseconds and delivering their bonding energy in the form of UV radiation when they decay. Wavelength ranges:

| Noble gas | UV radiation |
|---|---|
| $He^*_2$ | 60-100 nm |
| $Ne^*_2$ | 80-90 nm |
| $Ar^*_2$ | 107-165 nm |
| $Kr^*_2$ | 140-160 nm |
| $Xe^*_2$ | 160-190 nm |

In a first embodiment of the known radiator, the UV light generated reaches the external space via a front-end window in the dielectric tube. In a second embodiment, the wide faces of the tube are provided with metal foils which form the electrodes. On the narrow faces, the tube is provided with cut-outs over which special windows are cemented through which the radiation can emerge.

The efficiency which can be achieved with the known radiator is in the order of magnitude of 1% i.e., far below the theoretical value of around 50% because the filling gas heats up excessively. A further deficiency of the known radiator is to be perceived in the fact that, for stability reasons, its light exit window has only a relatively small area.

OBJECT OF THE INVENTION

Starting from what is known, the invention is based on the object of providing a high-power radiator, in particular of ultraviolet light, which has a substantially higher efficiency and can be operated with higher electrical power densities, and whose light exit area is not subject to the limitations described above.

SUBJECT OF THE INVENTION

This object is, according to the invention, achieved by a generic high-power radiator wherein both the dielectric and also the first electrodes are transparent to the radiation and at least the second electrodes are cooled.

In this manner a high-power radiator is created which can be operated with high electrical power densities and high efficiency. The geometry of the high-power radiator can be adapted within wide limits to the process in which it is employed. Thus, in addition to large-area flat radiators, cylindrical radiators are also possible which radiate inwards or outwards. The discharges can be operated at high pressure (0.1-10 bar). With this construction, electrical power densities of 1-50 $Kw/m^2$ can be achieved. Since the electron energy in the discharge can be substantially optimized, the efficiency of such radiators is very high, even if resonance lines of suitable atoms are excited. The wavelength of the radiation may be adjusted by the type of filling gas, for example mercury (185 nm, 254 nm), nitrogen (337-415 nm), selenium (196, 204, 206 nm), xenon (119, 130, 147 nm), and krypton (124 nm). As in other gas discharges, the mixing of different types of gas is also recommended.

The advantage of this radiator lies in the planar radiation of large radiation powers with high efficiency. Almost the entire radiation is concentrated in one or a few wavelength ranges. In all cases it is important that the radiation can emerge through one of the electrodes. This problem can be solved with transparent, electrically conducting layers or else by using a fine-mesh wire gauze or deposited conductor tracks as an electrode, which ensures the supply of current to the dielectric and, on the other hand, are substantially transparent to the radiation. A transparent electrolyte, which is advantageous, in particular, for the irradiation of water/waste water, since in this manner the radiation generated penetrates directly into the liquid to be irradiated and the liquid simultaneously serves as coolant.

SHORT DESCRIPTION OF THE DRAWINGS

The drawing shows exemplary embodiments of the invention diagrammatically, and in particular FIG. 1 shows in section an exemplary embodiment of the invention in the form of a flat panel radiator;

FIG. 2 shown in section a cylindrical radiator which radiates outwards and which is built into a radiation container for flowing liquids or gases;

DETAILED DESCRIPTION OF THE INVENTION

Figure 1:
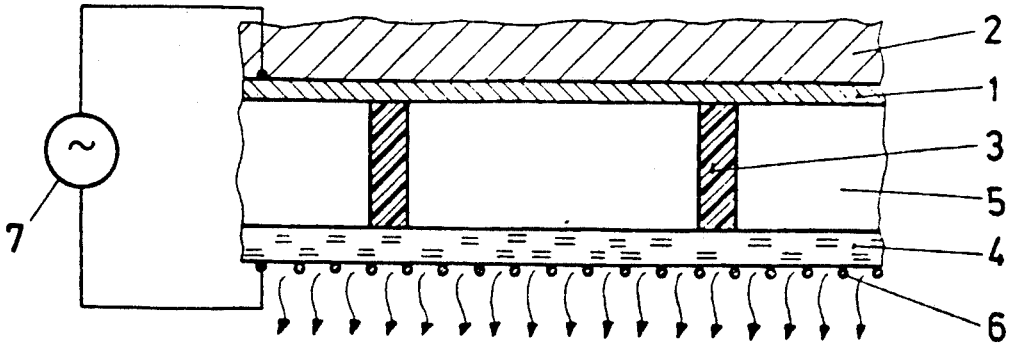

The high-power radiator according to FIG. 1 comprises a metal electrode 1 which is in contact on a first side with a cooling medium 2, for example water. On the other side of the metal electrode 1 there is disposed — spaced by electrically insulating spacing pieces 3 which are distributed at points over the area — a plate 4 of dielectric material. For a UV high-power radiator, the plate 4 consists, for example, of quartz or sapphire which is transparent to UV radiation. For very short wavelength radiations, materials such as, for example, magnesium fluoride and calcium fluoride, are suitable. For radiators which are intended to deliver radiation in the visible region of light, the dielectric is glass. The dielectric plate 4 and the metal electrode 1 form the boundary of a discharge space 5 having a typical gap width between 1 and 10 mm. On the surface of the dielectric plate 4 facing away from the discharge space 5 there is deposited a fine wire gauze 6, only the beam or weft threads of which are visible in FIG. 1. Instead of a wire gauze, a transparent electrically conducting layer may also be present, it being possible to use a layer of indium oxide of tin oxide for visible light, 50–100 Å thick gold layer for visible and UV light, and, especially in the UV, also a thin layer of alkali metals. An alternating current source 7 is connected between the metal electrode 1 and the counter-electrode (wire gauze 6).

As alternating current source 7, those sources can generally be used which have long been used in connection with ozone generators.

The discharge space 5 is closed laterally in the usual manner, has been evacuated before sealing, and is filled with an inert gas or a substance forming excimers under discharge conditions--for example, mercury, a noble gas, a noble gas/metal vapour mixture, or a noble gas/-halogen mixture, if necessary using an additional further noble gas (Ar, He, Ne) as a buffer gas.

Depending on the desired spectral composition of the radiation, a substance according to the table below may be used:

| Filling gas | Radiation |
|---|---|
| Helium | 60–100 nm |
| Neon | 80–90 nm |
| Argon | 107–165 nm |
| Xenon | 160–190 nm |
| Nitrogen | 337–415 nm |
| Krypton | 124 nm, 140–160 nm |
| Krypton + fluorine | 240–225 nm |
| Mercury | 185, 254 nm |
| Selenium | 196, 204, 206 nm |
| Deuterium | 150–250 nm |
| Xenon + fluorine | 400–550 nm |
| Xenon + chlorine | 300–320 nm |

In the quiet discharge (dielectric barrier discharge) which forms, the electron energy distribution can be optimally adjusted by varying the gap width of the discharge spaces, the pressure and/or the temperature (by means of the intensity of cooling).

Figure 2:
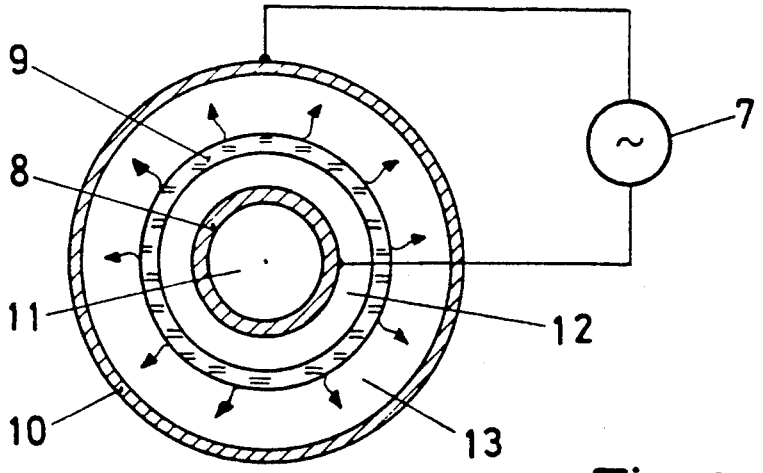

In the exemplary embodiment according to FIG. 2, a metal tube 8 enclosing an internal space 11, a tube 9 of dielectric material spaced from the metal tube 8 and an outer metal tube 10 are disposed coaxially inside each other. Cooling liquid or a gaseous coolant is passed through the internal space 11 of the metal tube 8. An annular gap 12 between the tubes 8 and 9 forms the discharge space. Between the dielectric tube 9 (in the case of the example, a quartz tube) and the outer metal tube 10 which is spaced form the dielectric tube 9 by a further annular gap 13, the liquid to be radiated is situated. In the case of the example, the liquid to be radiated is water which, because of its electrolytic properties, forms the other electrode. The alternating current source 7 is consequently connected to the two metal tubes 8 and 10.

This arrangement has the advantage that the radiation can act directly on the water, the water simultaneously serves as coolant, and consequently a separate electrode on the outer surface of the dielectric tube 9 is unnecessary.

If the liquid to be radiated is not an electrolyte, one of the electrodes mentioned in connection with FIG. 1 (transparent electrically conducting layer, wire gauze) may be deposited on the outer surface of the dielectric tube 9.

Figure 3:
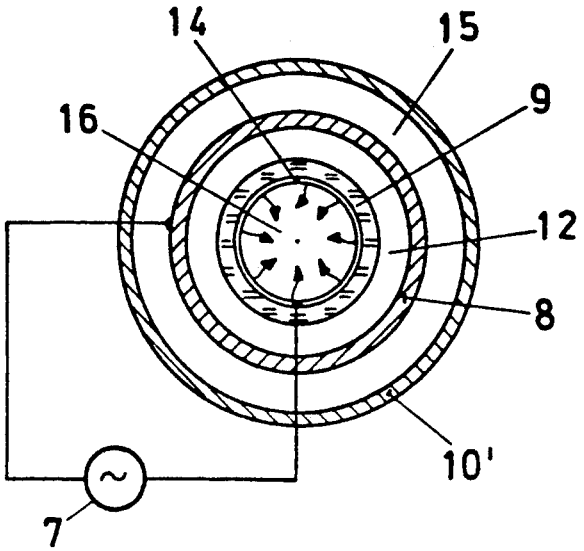
FIG. 3 shows a cylindrical radiator which radiates inwards for photochemical reactions.

In the exemplary embodiment according to FIG. 3, a quartz tube 9 provided with a transparent electrically conducting the internal electrode 14 is coaxially disposed in the metal tube 8. Between the two tube 8, 9 there extends the annular discharge gap 12. The metal tube 8 is surrounded by an outer tube 10' to form an annular cooling gap 15 through which a coolant (for example, water) can be passed. The alternating current source 7 is connected between the internal electrode 14 and the metal tube 8.

In this embodiment, the substance to be radiated is passed through the internal space 16 of the dielectric tube 9 and serves, provided it is suitable, simultaneously as coolant.

An electrolyte, for example water, may also be used as an electrode in the arrangement according to FIG. 3 in addition to solid internal electrodes 14 (layers, wire gauze) deposited on the inside of the tube.

Both in the outward radiators according to FIG. 2 and also in the inward radiators according to FIG. 3, the spacing or relative fixing of the individual tubes with respect to each other is carried out by means of spacing elements as they are used in ozone technology.

Figure 4:
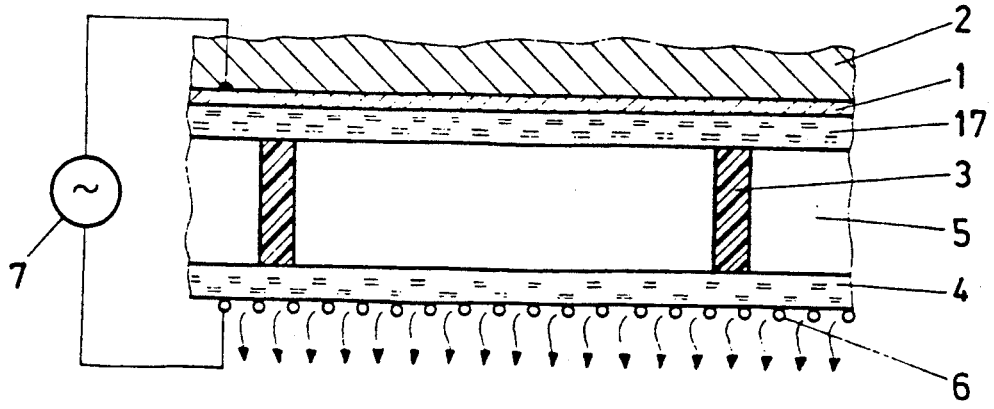
FIG. 4 shows a modification of the radiator according to FIG. 1 with a discharge space bounded on both sides by a dielectric.

Experiments have shown that it may be advantageous to use hermetically sealed discharge geometries (for example, sealed off quartz or glass containers) in the case of certain filling gases. In such a configuration the filling gas no longer comes into contact with a metallic electrode, and the discharge is bounded on all sides by dielectrics. The basic construction of a high-power radiator of this type is evident from FIG. 4. In FIG. 4 parts with the same function as in FIG. 1 are provided with the same reference symbols. The basic difference between FIG. 1 and FIG. 4 is in the interposing of a second dielectric 17 between the discharge space 5 and the metal electrode 1. As in the case of FIG. 1, the metallic electrode 1 is cooled by a cooling medium 2; the radiation leaves the discharge space 5 through the dielectric plate 4, which is transparent to the radiation, and the wire gauze 6 serving as second electrode.

Figure 5:
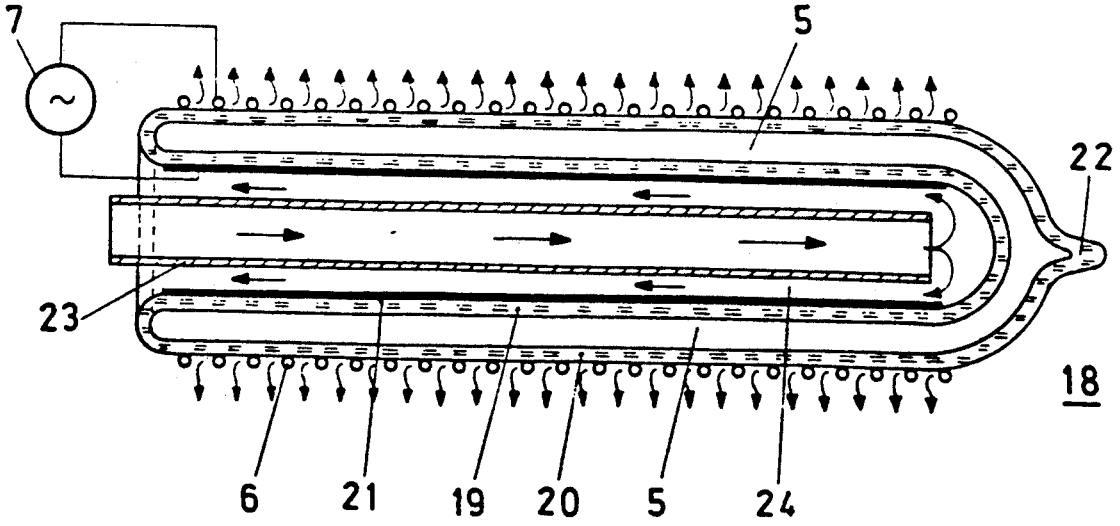
FIG. 5 shows an exemplary embodiment of a radiator in the form of a double-walled quartz tube.

A practical implementation of a high-power radiator of this type is shown diagrammatically in FIG. 5. A double-walled quartz tube 18, consisting of an internal tube 19 and an external tube 20, is surrounded on the outside by the wire gauze 6 which serves as a first electrode. The second electrode is constructed as a metal layer 21 on the internal wall of the internal tube 19. The alternating current source 7 is connected to these two electrodes. The annular space between the internal and external tubes 19 and 20 serves as the discharge space 5. The discharge space 5 is hermetically sealed with respect to the external space by sealing off the filling nozzle 22. The cooling of the radiator takes place by passing a coolant through the internal space of the internal tube 19, a tube 23 being inserted for conveying the coolant into the internal tube 19 with an annular space 24 being left between the internal tube 19 and the tube 23. The direction of flow of the coolant is made clear by arrows. The hermetically sealed radiator according to FIG. 5 can also be operated as an inward radiator analogously to FIG. 3 if the cooling is applied from the outside and the UV-transparent electrode is applied on the inside.

In the light of the explanations relating to the arrangements described in FIGS. 1 to 3, it goes without saying that the high-power radiators according to FIGS. 4 and 5 may be modified in diverse ways without leaving the scope of the invention: Thus, in the embodiment according to FIG. 4, the metallic electrode 1 can be dispensed with if the cooling medium is an electrolyte which simultaneously serves as electrode. The wire gauze 6 may also be replaced by an electrically conductive layer which is transparent to the radiation.

In the case of FIG. 5 the wire gauze 6 can also be replaced by a layer of this type. If the metal layer 21 is formed as a layer transparent to the radiation (for example of indium oxide or tin oxide) the radiation can act directly on the cooling medium (for example, water). If the coolant itself is an electrolyte, it can take over the electrode function of the metal layer 1.

In the proposed incoherent radiators, each element of volume in the discharge space will radiate its radiation into the entire solid angle $4\pi$. If it is only desired to utilize the radiation which emerges from the UV-transparent wire gauze 6, the usuable radiation can virtually be doubled if the metal layer 21 is of a material which reflects UV radiation well (for example, aluminum). In the arrangement of FIG. 5, the inner electrode could be an aluminum evaporated layer.

For the UV-transparent, electrically conductive electrode, thin (0.1–1 $\mu$m) layers of alkali metals are also suitable. As is known, the alkali metals lithium, potassium, rubidium and cesium exhibit a high transparency with low reflection in the ultraviolet spectral range. Alloys (for example, 25% sodium/75% potassium) are also suitable. Since the alkali metals react with air (in some cases very violently), they have to be provided with a UV-transparent protective layer (e.g. $MgF_2$) after deposition in vacuum.

We claim:

1. High-power radiator for ultraviolet light, said high-power radiator comprising:

(a) a first dielectric member having a first surface and a second surface, said first dielectric member being transparent to UV radiation;

(b) a first electrode separated from the first surface of said first dielectric member by discharge space;

(c) a second electrode that is transparent to UV radiation deposited on the second surface of said first dielectric member;

(d) a gas that forms excimers under silent discharge conditions disposed in said discharge space, said gas directly contacting one of said first and second electrodes; and (e) a source of alternating current connected to said first and second electrodes.

2. A high-power radiator for ultraviolet light, said high-power radiator comprising:

(a) a first dielectric member having a first surface and a second surface;

(b) a first electrode separated from the first surface of said first dielectric member by discharge space;

(c) a second electrode that is transparent to UV radiation deposited on the second surface of said first dielectric member;

(d) a gas that forms excimers under discharge conditions disposed in said discharge space, said gas directly contacting one of said first and second electrodes; and (e) a source of alternating current connected to said first and second electrodes.

3. A high-power radiator as recited in claim 2 wherein said first electrode is a metal electrode.

4. A high-power radiator as recited in claim 2 wherein said first dielectric member and said first electrode are plate-shaped.

5. A high-power radiator as recited in claim 2 wherein said dielectric member is made from a material selected from the group consisting of quartz, sapphire, magnesium fluoride, calcium fluoride, and glass.

6. A high-power radiator as recited in claim 2 wherein said second electrode is selected from the group consisting of a fine wire of gauze and a transparent electrically conducting layer.

7. A high-power radiator as recited in claim 6 wherein said second electrode is a transparent electrically conducting layer selected from the group consisting of indium oxide, tin oxide, gold, and alkali metals.

8. A high-power radiator as recited in claim 2 further comprising a means for cooling said first electrode.

9. A high density power radiator for ultraviolet light, said high-power radiator comprising:

a first dielectric member having a first surface and a second surface, such first dielectric member being transparent to UV radiation;

a first electrode separated from the first surface of said first dielectric member by a discharge space;

a second electrode that is transparent to UV radiation deposited on the second surface of said first dielectric member;

a gas that forms excimers under dielectric barrier discharge conditions disposed in said discharge space, said gas directly contacting said first surface of said first dielectric member and wherein said discharge conditions include a high pressure of between 0.1 and 10 bar;

a source of alternating current connected to said first and second electrodes;

cooling means for cooling at least first electrode; and wherein the electrical power density of said high-power radiator is between 1 and 50 $kW/m^2$.

* * * * *

UNITED STATES PATENT AND TRADEMARK OFFICE

CERTIFICATE OF CORRECTION

PATENT NO. : 5,173,638

DATED : December 22, 1992

INVENTOR(S) : Baldur Eliasson et al.

It is certified that error appears in the above-identified patent and that said Letters Patent is hereby corrected as shown below:

On the title page, Item [63],

The Related U.S. Application Data is incorrect, should be,

--Continuation of Ser. No. 405,574, Sep. 7, 1989, abandoned, which is a continuation of Ser. No. 294,740, Jan. 9, 1989, abandoned, which is a continuation of Ser. No. 76,926, Jul. 22, 1987, Pat. No. 4,837,484.--

Signed and Sealed this

Ninth Day of November, 1993

Bruce Lehman

*Attest:*

BRUCE LEHMAN

*Attesting Officer*

*Commissioner of Patents and Trademarks*